US008277953B2

(12) United States Patent
Linde et al.

(10) Patent No.: US 8,277,953 B2
(45) Date of Patent: Oct. 2, 2012

(54) PRODUCTION OF STRUCTURED HARD CHROME LAYERS

(75) Inventors: Rudolf Linde, Koenigswinter (DE); Stefan Durdoth, Burscheid (DE)

(73) Assignee: Federal-Mogul Burscheid GmbH, Burscheid (DE)

( * ) Notice: Subject to any disclaimer, the term of this patent is extended or adjusted under 35 U.S.C. 154(b) by 138 days.

(21) Appl. No.: 12/683,890

(22) Filed: Jan. 7, 2010

(65) Prior Publication Data

US 2010/0112376 A1 May 6, 2010

Related U.S. Application Data

(62) Division of application No. 10/536,665, filed on May 27, 2005, now Pat. No. 7,699,970.

(30) Foreign Application Priority Data

Nov. 29, 2002 (DE) ..... 102 55 853

(51) Int. Cl.
*B32B 3/10* (2006.01)
*B32B 3/30* (2006.01)
*B32B 15/01* (2006.01)
*B32B 15/04* (2006.01)

(52) U.S. Cl. ..... 428/666; 428/601; 428/600; 428/614; 428/615; 428/621; 428/457

(58) Field of Classification Search ..... None
See application file for complete search history.

(56) References Cited

U.S. PATENT DOCUMENTS 3,139,393 A 6/1964 Passal et al.
3,901,659 A * 8/1975 Joklik et al. ..... 165/104.31
3,920,527 A 11/1975 Dettke et al.
3,951,759 A * 4/1976 Studer ..... 205/148
4,468,293 A 8/1984 Polan et al.
(Continued)

FOREIGN PATENT DOCUMENTS

CA 2172613 4/1995
(Continued)

OTHER PUBLICATIONS

Gardam, "The Production of Machinable Cr Deposits", J. of the Electrodepositors' Technical Soc. (No month, 1945), vol. 20, pp. 69-74. Abstract Only.

(Continued)

*Primary Examiner* — Jennifer McNeil
*Assistant Examiner* — Jason Savage
(74) *Attorney, Agent, or Firm* — Patterson Thuente Christensen Pedersen, P.A.

(57) ABSTRACT

The present invention relates to an apparatus with a structured hard chrome layer electrodeposited onto a work-piece, the structured hard chrome layer being cup-shaped and/or labyrinth-like and/or column-shaped. The structured hard chrome layer can be electrodeposited from an electrolyte onto the work-piece, said electrolyte containing (a) a Cr (VI) compound in an amount corresponding to 50 g/l to 600 g/l of chromic acid anhydride; (b) 0.5 g/l to 10 g/l of sulphuric acid; (c) 1 g/l to 20 g/l of aliphatic sulphonic acid, comprising 1 to 6 carbon atoms; and (d) 10 g/l to 200 g/l of at least one compound forming a dense cathode film, said compound being selected from among ammonium molybdate, alkali molybdate and alkaline earth molybdate, ammonium vanadate, alkali vanadate and alkaline earth vanadate, ammonium zirconate, alkali zirconate and alkaline earth zirconate.

8 Claims, 8 Drawing Sheets

Projecting Region

Recessed Region

U.S. PATENT DOCUMENTS

| | | | | |
|---|---|---|---|---|
| 4,588,481 | A | 5/1986 | Chessin et al. | |
| 4,590,239 | A | 5/1986 | Sugio et al. | |
| 4,846,940 | A | 7/1989 | Neuhauser et al. | |
| 5,196,108 | A | 3/1993 | Wilmeth et al. | |
| 5,415,761 | A | 5/1995 | Mull | |
| 5,415,763 | A | 5/1995 | Johnson et al. | |
| 6,319,385 | B1 | 11/2001 | Mull | |
| 6,329,071 | B1 | 12/2001 | Kobayashi et al. | |
| 6,355,366 | B1 * | 3/2002 | Santini | 428/698 |
| 6,447,666 | B1 * | 9/2002 | Szameitat | 205/290 |
| 6,478,943 | B1 * | 11/2002 | Lasia et al. | 205/82 |
| 6,503,642 | B1 | 1/2003 | Linde | |
| 6,562,216 | B2 * | 5/2003 | Schlenkert et al. | 205/104 |
| 6,837,981 | B2 | 1/2005 | Horsthemke | |
| 7,699,970 | B2 | 4/2010 | Linde et al. | |
| 2003/0121794 | A1 | 7/2003 | Horsthemke | |
| 2006/0054509 | A1 | 3/2006 | Linde et al. | |
| 2007/0131558 | A1 | 6/2007 | Horsthemke et al. | |
| 2008/0060945 | A1 | 3/2008 | Linde et al. | |

FOREIGN PATENT DOCUMENTS

| | | | |
|---|---|---|---|
| CS | 214553 | | 5/1982 |
| DE | 33 07 748 | A1 | 9/1983 |
| DE | 35 31 410 | | 3/1987 |
| DE | 42 11 881 | A1 | 10/1993 |
| DE | 43 34 122 | A1 | 4/1995 |
| DE | 44 32 512 | A1 | 3/1996 |
| DE | 198 28 545 | C1 | 8/1999 |
| DE | 102 55 853 | | 6/2004 |
| DE | 10 2004 019 370 | | 9/2005 |
| EP | 0196053 | | 10/1986 |
| EP | 0 217 126 | | 4/1987 |
| EP | 0 668 375 | | 8/1995 |
| EP | 0 841 413 | | 5/1998 |
| EP | 1 205 582 | A1 | 5/2002 |
| EP | 1 719 827 | | 11/2006 |
| EP | 1 798 313 | | 6/2007 |
| EP | 1 114 209 | | 7/2011 |
| FR | 2 558 852 | | 8/1985 |
| GB | 2153387 | | 8/1985 |
| WO | WO 01/04386 | | 1/2001 |
| WO | WO 02/38835 | A1 | 5/2002 |
| WO | WO2004/050960 | | 6/2004 |
| WO | WO 2005/108648 | | 11/2005 |

OTHER PUBLICATIONS

Gardam, "The Production of Machinable Cr Deposits", J. of the Electrodepositors' Technical Soc. (no. month, 1945), vol. 20, pp. 69-74. Abstract Only.

English Machine Translation of DE 44 32 512. Printed from EPO website on Feb. 15, 2008. Pages 1-2.

U.S. Appl. No. 10/536,665, filed May 27, 2005, (US Patent Publication No. 2006/0054509, published Mar. 16, 2006) Inventors: Linde et al.

Application and File History for U.S. Appl. No. 10/536,665, filed May 27, 2005, inventors Linde et al.

Application and File History for U.S. Appl. No. 11/587,117, filed Oct. 20, 2006, inventors Linde et al.

Application and File History for U.S. Appl. No. 12/936,158, filed Dec. 21, 2010, inventor Linde et al.

* cited by examiner

Recessed Region

Projecting Region

Projecting Region

Recessed Region

Projecting Region

Recessed Region

Projecting Region

Recessed Region

Recessed Region

Projecting Region

Tin

Chrome

Projecting Region

Recessed Region

PRODUCTION OF STRUCTURED HARD CHROME LAYERS

RELATED APPLICATIONS

This application is a divisional of application Ser. No. 10/536,665, filed May 27, 2005, now U.S. Pat. No. 7,699,970, claims priority to PCT Application No. PCT/EP2003/010425 filed Sep. 18, 2003, and German Patent Application No. 10255853.1 filed Nov. 29, 2002, the specifications of which are incorporated herein by reference in their entirety.

FIELD OF THE INVENTION

The invention relates to a method of producing a structured hard chrome layer on a workpiece, to structured hard chrome layers obtainable thereby and to an electrolyte for carrying out said method.

BACKGROUND OF THE INVENTION

Electrochemically or galvanically deposited chromium layers have been considered prior art for many years in functional and decorative fields of use and in applications for coating electrically conductive and non-conductive workpieces.

The use of structured, electrochemically produced hard chrome layers has gained increasing importance in the past few years and especially recently. In particular, the use of functional structures is showing a strong upward trend. Typical applications are found in the coating of printing rollers for better wetting thereof with ink, in rollers for embossing metal sheets, for improving the deep-drawing processes for the automobile industry and also in storage, for protection against wear and for reduction of friction.

However, the structured layers employed according to the prior art all have a pronounced spherical laminar structure. The size of the spherical shapes varies between less than 1 μm and several μm. The degree of occupation or the density of the spherical laminar structure is more or less variable, depending on the particular method.

SUMMARY AND DETAILED DESCRIPTION

Thus, according to DE 33 077 48 A1, DE 42 11 881 A1 and DE 43 34 122 A1, structured chrome layers are produced by variation of direct electric currents, with the build-up of the structures being influenced by varying the height of current ramps and of current impulses.

Spherical structures are also produced according to DE 44 32 512 A1. In this case, however, their growth is made possible by adding salts of the elements selenium or tellurium to the chrome-plating electrolyte.

According to DE 19828545 C1, the addition of 2-hydroxyethanesulphonate ions to the electrolyte in combination with its temperature variation and the variation of the direct electric current applied also results in spherical structures.

However, all of these aforementioned structured chrome layers have the same, more or less strongly pronounced spherical characteristic, which is not suitable for all applications. Some of these layers are non-uniform and the process for their deposition is subject to several mechanisms, which cannot be safely controlled.

WO 02/38835 A1 discloses a method for electrolytic coating of materials, wherein a chromium alloy is deposited from an electrolyte containing at least chromic acid, sulphuric acid, or a metal forming isopoly anions, a short-chain aliphatic sulphuric acid, their salts and/or their halogen derivatives and fluorides. This prior art document does not mention the production of a structured hard chrome layer.

Therefore, it is an object of the present invention to provide a method for producing a structured hard chrome layer, which method does not have the disadvantages of the prior art.

According to the invention, this is achieved by a method for producing a structured hard chrome layer, wherein chromium is deposited from an electrolyte on a workpiece, said electrolyte containing:

(a) a Cr(VI) compound in an amount corresponding to 50 g/l to 600 g/l of chromic acid anhydride;
(b) 0.5 g/l to 10 g/l of sulphuric acid;
(c) 1 g/l to 20 g/l of aliphatic sulphonic acid comprising 1 to 6 carbon atoms, and
(d) 10 g/l to 200 g/l of at least one compound forming a dense cathode film and selected from among ammonium molybdate, alkali molybdate and alkaline earth molybdate, ammonium vanadate, alkali vanadate and alkaline earth vanadate, ammonium zirconate, alkali zirconate and alkaline earth zirconate.

The method according to the invention is optimally suited for application in producing structured hard chrome layers.

A structured hard chrome layer is obtained by the method according to the invention by selectively influencing the cathode film forming during electrochemical deposition of metals, said hard chrome layer being cup-shaped and/or labyrinth-like and/or column-shaped.

If salts are dissolved in water, they dissociate into cations and anions. At the same time, these dissociated ions surround themselves with a hydrate sheath, i.e. water molecules deposit (as dipoles) around the cations or the anions, respectively. During hydration, the charge number of the ions is not changed. If a hydrated metal ion begins to migrate under the influence of electric current, it will enter near the cathode, into a border area, between the electrolyte and the cathode.

This so-called cathode film is located directly on the surface of the workpiece to be coated, because the workpiece is negatively switched electrically. In this phase boundary the metal ions present in the electrolyte are first aligned by picking up electrons which are provided by the electric current from the cathode. Located directly on the surface of the workpiece, below the diffusion zone, is an electrochemical bilayer, also referred to as "Helmholtz bilayer". This term relates to the electrically charged zone at the electrolyte/electrode interface, said zone having a thickness of approximately a few atom or molecule layers. The formation of said zone depends on ions, electrons or aligned dipole molecules. It is positively charged on one side, negatively charged on the other side and behaves like a plate capacitor having an extremely small plate distance. The metal atom thus formed is now present on the surface of the workpiece. However, its condition is not yet comparable with that of an atom within the metal. The atoms formed will only take their places in the present metal grid, if a so-called growth site is present.

The conditions of the position of the electrolytes, such as chemical composition, temperature, hydrodynamics and electric current, are usually selected such that the basic material is uniformly covered with the metal to be deposited. That is, the cathode film is influenced by this measure such that its permeability for the present ions is as uniform as possible.

Chromium as an element is present in aqueous solutions, as compared with most elements that can be electrochemically deposited, as a negatively charged complex ion, mainly as hydrogen dichromate in strongly acidic solution.

In this complex, chromium has an oxidation state of 6. In addition, electrolytes also contain reduced amounts of chromium (III) compounds.

If such aqueous solution is electrolysed, a solid film preventing chrome deposition forms on the cathode. Only hydrogen is produced, which can pass through the solid cathode film due to the small radius of hydrogen, but not the large hydrogen dichromate ions. Only by adding foreign anions, e.g. sulphate and chloride, does the cathode film become permeable to chromium ions and deposition of chromium occurs via various oxidation stages (see "Chemie für die Galvanotechnik" LEUTZE Verlag, second edition, 1993).

By adding to the electrolyte at least one compound forming a dense cathode film, the formation of the cathode film is controlled such that it becomes permeable to chromium ions, so that a very dense barrier layer forms first, which then breaks down depending on the density of the applied electric current for coating and allows the metal structure to form with different strength or layer thickness. In this manner, structured chromium layers are obtained, which are cup-shaped and/or labyrinth-like and/or column-shaped.

The chrome layer obtained according to the method of the invention has high resistance to wear and corrosion, excellent sliding properties and resistance to seizure and also an aesthetically favourable appearance, which is achieved by hardly any other coating. Due to its cup-shaped and/or labyrinth-like and/or column-shaped structure, the hard chrome layer can be used for many functional or even decorative applications. Thus, for example, the specific structure of the layer ensures an improved capacity for absorption of liquids. Further, it is possible to form a gas pad as well as to achieve an improved anchoring ability for substances to be deposited therein, e.g. plastic materials, dyes, metals, ceramic materials, electronic components, body-specific tissue, as a coating for implants. Further, due to its surface topography, said specific structure enables intentional optical effects, e.g. a high adsorption capacity for light radiation and heat radiation using solar collectors, and also decorative applications in the design field.

The term "electrolyte" in the sense of the present invention relates to aqueous solutions whose electric conductivity results from electrolytic dissociation in ions. Accordingly, in addition to components (a) to (d) and optionally further present additives, the electrolyte comprises water as the remainder.

The above-indicated quantities of components (a) to (d) relate to the electrolyte.

As component (a), $C_rO_3$ is preferably used, which has proved to be particularly favourable with regard to the electrolytic deposition of chromium.

An aliphatic sulphonic acid preferably used as component (c) is methane sulphonic acid. This acid has turned out to be particularly favourable in forming the structured hard chrome layers having the aforementioned properties.

As alkali ions for component (d) $Li^+$, $Na^+$ and $K^+$ may be used. Examples of alkaline earth ions are $Mg^{2+}$ and $Ca^{2+}$. In a preferred embodiment, component (d) is $(NH_4)6\ Mo_7O_{24}\cdot 4H_2O$, which has turned out to be particularly favourable in forming the structured hard chrome layer having the aforementioned properties.

The electrolyte referred to in more detail above is substantially free from fluorides, according to a particularly preferred embodiment. Herein, fluorides refer to both simple and complex fluorides. If fluorides are present in the electrolyte, this will interfere with the formation of the structured hard chrome layer. Accordingly, the term "substantially no fluorides" means that an amount of fluoride is tolerable in the electrolyte which does not influence the formation of the structured hard chrome layer. The amount of fluorides which are tolerable can be easily determined by the person skilled in the art. It has proven to be favourable, if no more than 0.1 g/l is present in the electrolyte.

The electrolyte may further contain conventional catalysts assisting in chromium deposition such as $SO4^{2-}$ and/or $Cl^-$. These compounds may be present in the electrolyte in the usual amounts.

Using the method according to the invention, structured hard chrome layers of the type described in more detail above are formed on workpieces. In this connection, the term "workpiece" refers to objects of any kind which are to be provided with a structured chromium layer. These may be metal or non-metal objects. If a structured hard chrome layer is to be formed on a non-metallic object, said object is made electrically conductive first by applying a thin metal film.

In order to form the structured hard chrome layer on the workpiece, the latter is cathodically switched and immersed in the electrolyte. A direct current, for example a pulsating direct current having a frequency of up to 1000 Hz, is applied to the workpiece. The temperature for depositing the chromium may be 45° C. to 95° C., in particular about 55° C. The duration of deposition is selected depending on the desired thickness of the structured hard chrome layers, the thickness of said layer increasing as the duration of said deposition increases.

In a preferred embodiment of the present invention, a current density of 20 $A/dm^2$ to 200 $A/dm^2$ is used. Thus, particularly favourable structures of the hard chrome layer are obtained. The higher the current density is selected to be, the more dense the protruding parts of the structured hard chrome layer will become.

The cathodic current yield in the production of the structured hard chrome layer according to the method of the invention is 12% or less. If the current yield is higher, the desired structure of the hard chrome layer will not be obtained.

It is possible to deposit a plurality of layers on the workpiece, wherein the above-mentioned structured hard chrome layers and layers formed by conventional electrolytes can be deposited on one another in an alternating manner. For example, first the structured hard chrome layer obtained by the method according to the invention can be applied to the workpiece, and then a layer selected from a conventional chromium layer, a black chromium layer, a copper layer, a nickel layer or a tin layer, may be deposited thereon. Further, a conventional chromium, copper and/or nickel layer may be deposited first on the workpiece, and then the hard chrome layer described in more detail above may be deposited thereon.

Further coatings which do not contain chromium, such as copper, nickel, tin, zinc, ceramics, plastics, solid lubricants, dyes, may be deposited directly onto the hard chrome layer obtained by the method according to the invention.

A further object of the present invention is a structured hard chrome layer of the type obtained by the method according to the invention as described in more detail above.

In contrast to the hard chrome layers of the prior art, which have a pronounced spherical laminar structure, the structured hard chrome layer has a cup-shaped and/or labyrinth-like and/or column-shaped structure. The structured hard chrome layer according the invention has the advantages mentioned in connection with the method according to the invention.

The structured hard chrome layer according to the invention may be used for coating a multitude of workpieces, for example piston rings, cylinders, pistons, bolts, camshafts, seals, composite materials, valves, bearings for protection against wear and for reduction of friction, pressure cylinders for improved wetting with dyes, embossing rollers for improved deep-drawing processes in the automobile industry, in solar technology, for decorative purposes, in medical technology, in micro-engineering and in microelectronics.

A further object of the present invention is an electrolyte, containing (a) a Cr (VI) compound in an amount corresponding to 50 g/l to 600 g/l of chromic acid anhydride,
(b) 0.5 g/l to 10 g/l of sulphuric acid,
(c) 1 g/l to 20 g/l of aliphatic sulphonic acid comprising 1 to 6 carbon atoms, and
(d) 10 g/l to 200 g/l of at least one compound forming a dense cathode film, said compound being selected from among ammonium molybdate, alkali molybdate and alkaline earth molybdate, ammonium vanadate, alkali vanadate and alkaline earth vanadate, and ammonium zirconate, alkali zirconate and alkaline earth zirconte.

for carrying out the method according to the invention.

Said electrolyte may be used, in particular, for producing the structured hard chrome layers described in more detail above on workpieces.

The present invention shall be explained in more detail in the following examples with reference to the figures, but without being limited thereto.

FIGS. 1 to 8 show photographs corresponding to the hard chrome layers of examples 1 to 8.

BRIEF DESCRIPTION OF THE DRAWINGS

FIG. 1 depicts the chrome layer of Example 1;
FIG. 2 depicts the chrome layer of Example 2;
FIG. 3 depicts the chrome layer of Example 3;
FIG. 4 depicts the chrome layer of Example 4;
FIG. 5 depicts the chrome layer of Example 5;
FIG. 6 depicts the chrome layer of Example 6;
FIG. 7 depicts the chrome layer of Example 7; and
FIG. 8 depicts the chrome layer of Example 8.

EXAMPLE 1

A conventional chromium electrolyte having the following basic composition was prepared:

Chromic acid anhydride $C_rO_3$ 250 g/l
Sulphuric acid $H_2SO_4$ 2.5 g/l

A product component is introduced into the electrolyte after conventional pre-treatment and is coated for 30 minutes at 55° C. with 41 A/dm$^2$.

Figure 1:
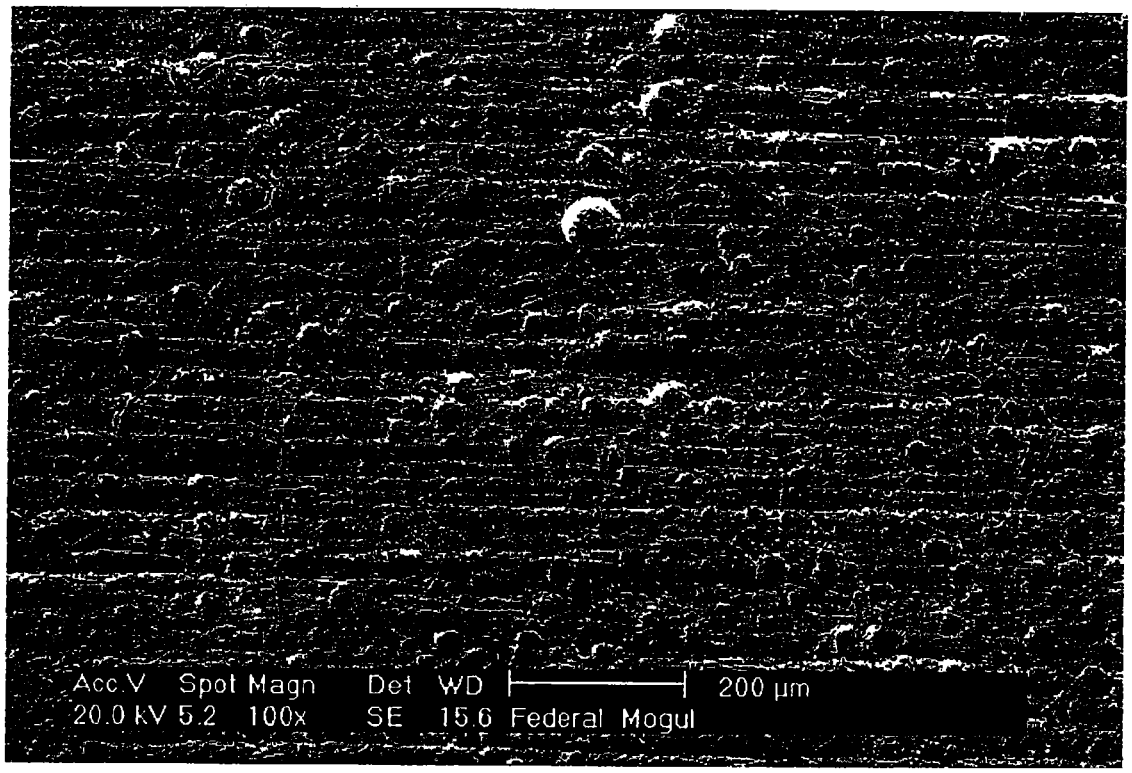
Prior Art Fig.1
FIGS. 1 to 8 show photographs corresponding to the hard chrome layers of examples 1 to 8.

The product component coated under these conditions comprises a conventional, glossy and uniformly structured chromium layer after treatment, cf. FIG. 1.

EXAMPLE 2

Figure 2:
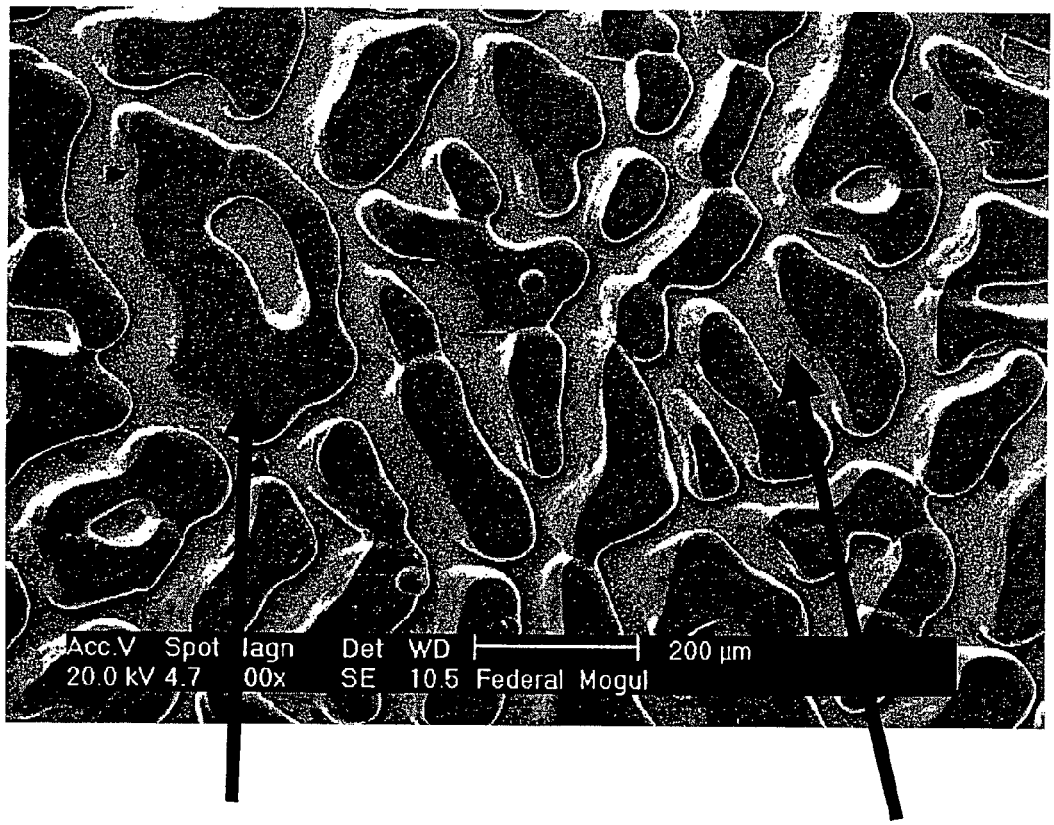

100 g/l of ammonium molybdate $(NH^4)_6$ $Mo_7O_{24}.4H_2O$ and 4 g/l of methane sulphuric acid are additionally added to the electrolyte of Example 1. A product component is coated under the conditions described in Example 1. The product component thus described comprises a structured chromium layer after treatment. Said chromium layer has a glossy appearance on the protruding surface regions (supporting portion), and a brown cathode film or barrier layer is obtained in the recesses of the structure (FIG. 2).

EXAMPLE 3

A product component is coated under the conditions of Example 2. However, instead of working with a coating current density of 40 A/dm$^2$, 20 A/dm$^2$ are used.

Figure 3:
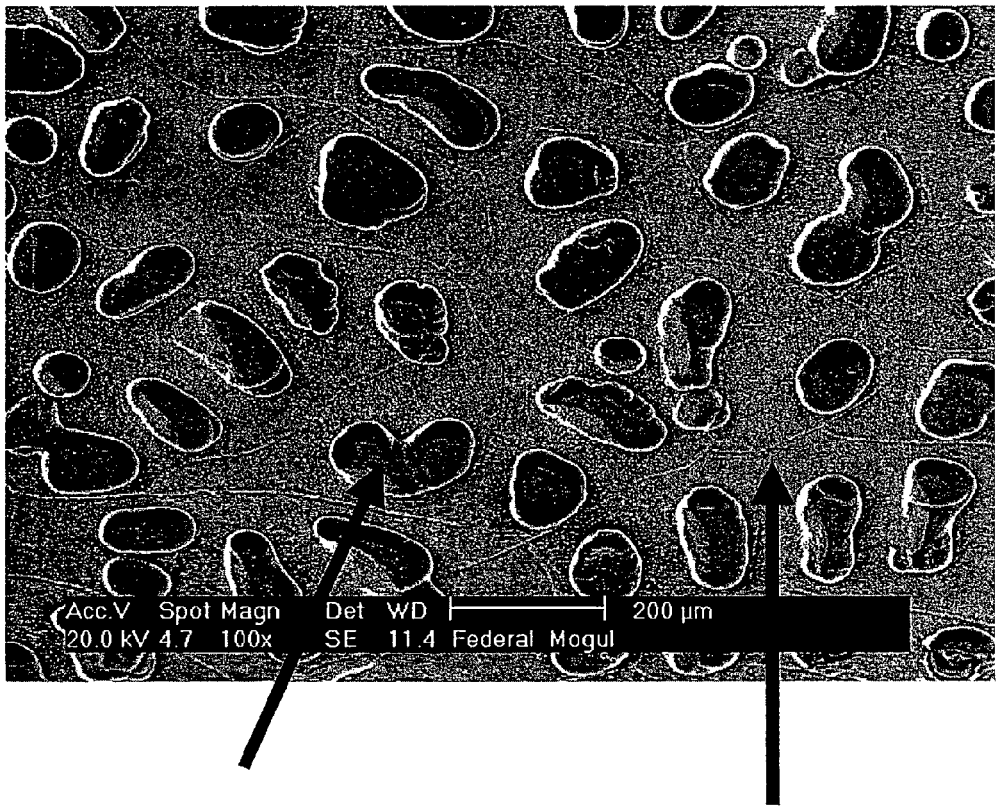

The product component thus coat comprises a structured chromium layer after treatment. The proportion of the protruding, glossy surface areas (supporting portion) is smaller and the proportion of recessed regions is greater by comparison with the structured layer of Example 2 (FIG. 3).

EXAMPLE 4

A product component is coated under the condition of Example 2. However, instead of working with a coating current density of 40 A/dm$^2$ 60 A/dm$^2$ are used.

Figure 4:
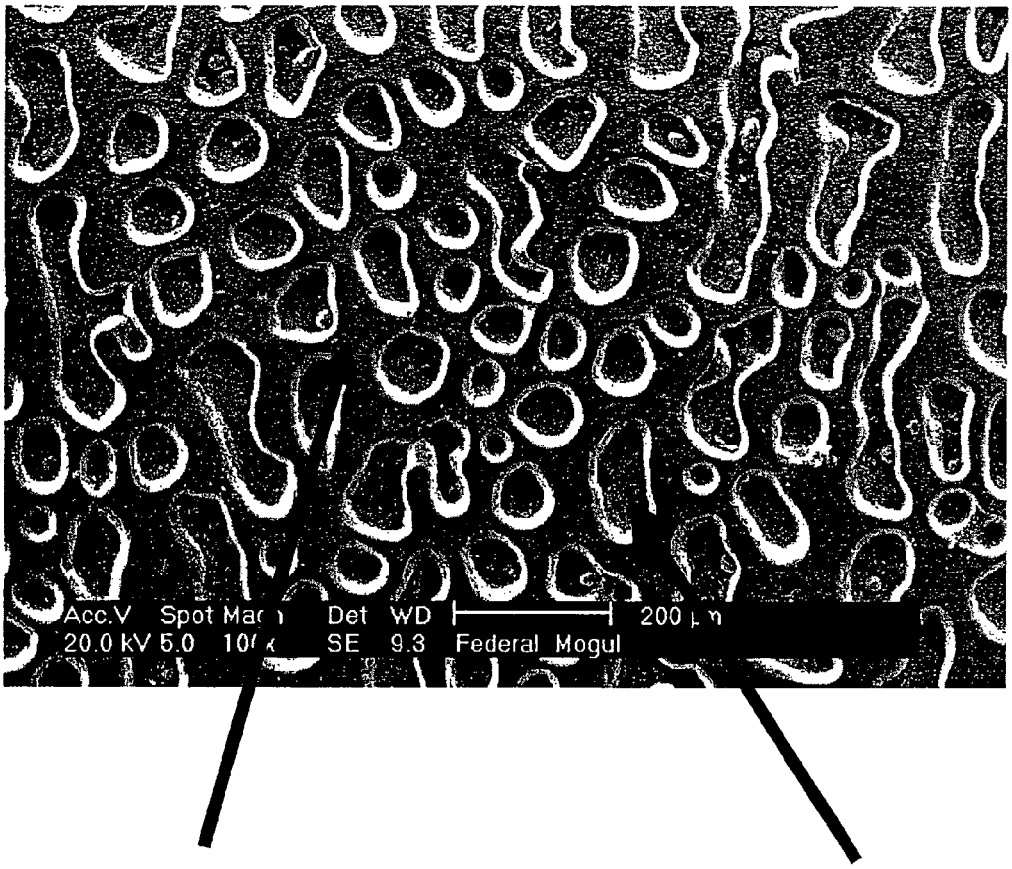

The product component coated in this manner comprises a structured chromium layer after treatment. The proportion of the protruding, glossy surface regions (supporting portion) is greater and the proportion of recessed areas is smaller by comparison with the structured layer of Example 2 (FIG. 4).

EXAMPLE 5

Figure 5:
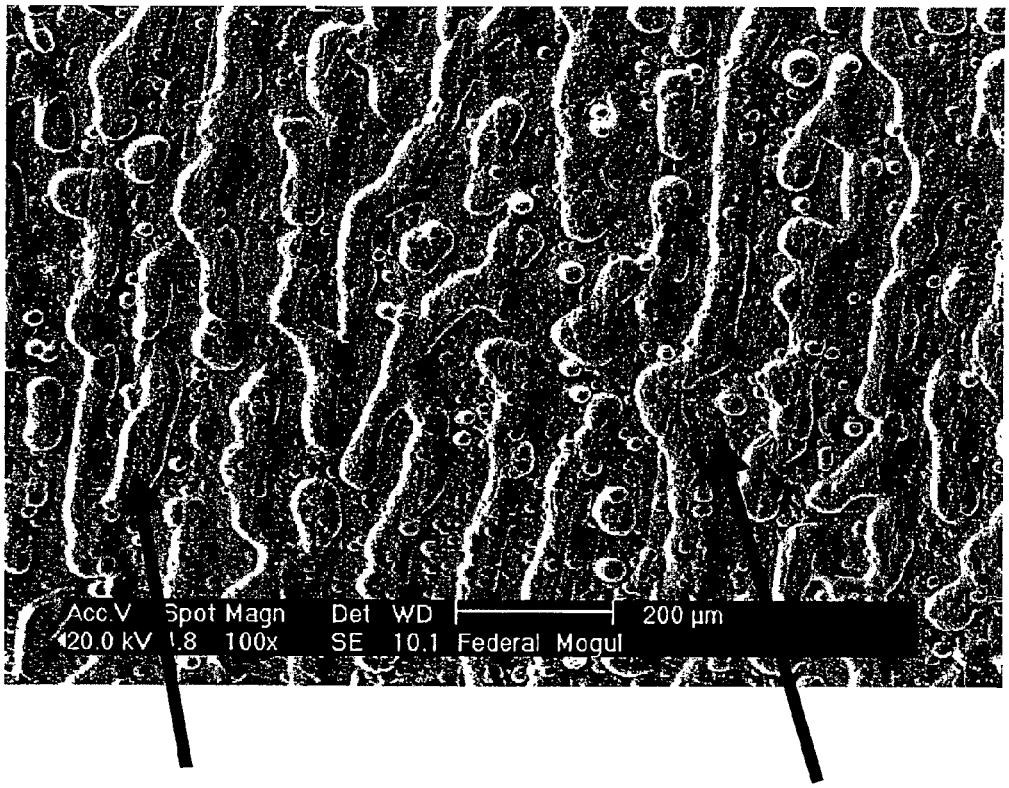

A product component is coated under the conditions of Example 2. The product component coated in this manner comprises a structured chromium layer after treatment. In a conventional chromium electrolyte of Example 1, coating is now continued on said structured chromium layer for 120 minutes using chromium at 55° C. and 50 A/dm$^2$. The product component coated in this manner exhibits a considerable increase in structural height as compared to Example 2 (FIG. 5).

This graded layer has, on its surface, metallurgic properties like conventional chromium and is structured in addition.

The advantage of this laminar structure results from the fact that the profile height of the laminar structure can be varied over a wide range, which is limited by the slow speed of growth of layers in the exclusive deposition according to Examples 2-4.

EXAMPLE 6

A product component is coated according to the conditions of Example 2. The product component coated in this manner comprises a structured chromium layer after treatment. A black, chromium oxide-containing layer is then deposited on this structured chromium layer in a conventional black-chromium electrolyte.

Figure 6:
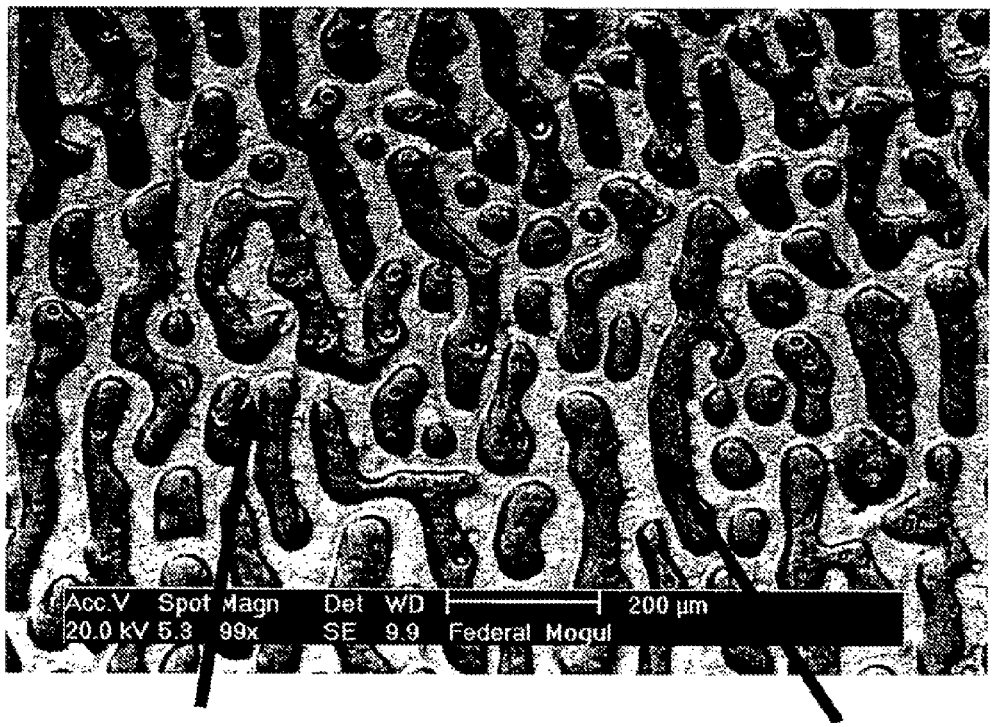

The product component coated in this manner has a uniform, deep-black surface with a very high index of light refraction (FIG. 6).

EXAMPLE 7

A product component is coated according to the conditions of Example 2. The product component coated in this manner comprises a structured chromium layer after treatment. In a conventional tin electrolyte, a tin layer is then deposited on this structured chromium layer, with a thickness sufficient to fill up the recesses of the structured chromium layer with tin.

Figure 7:
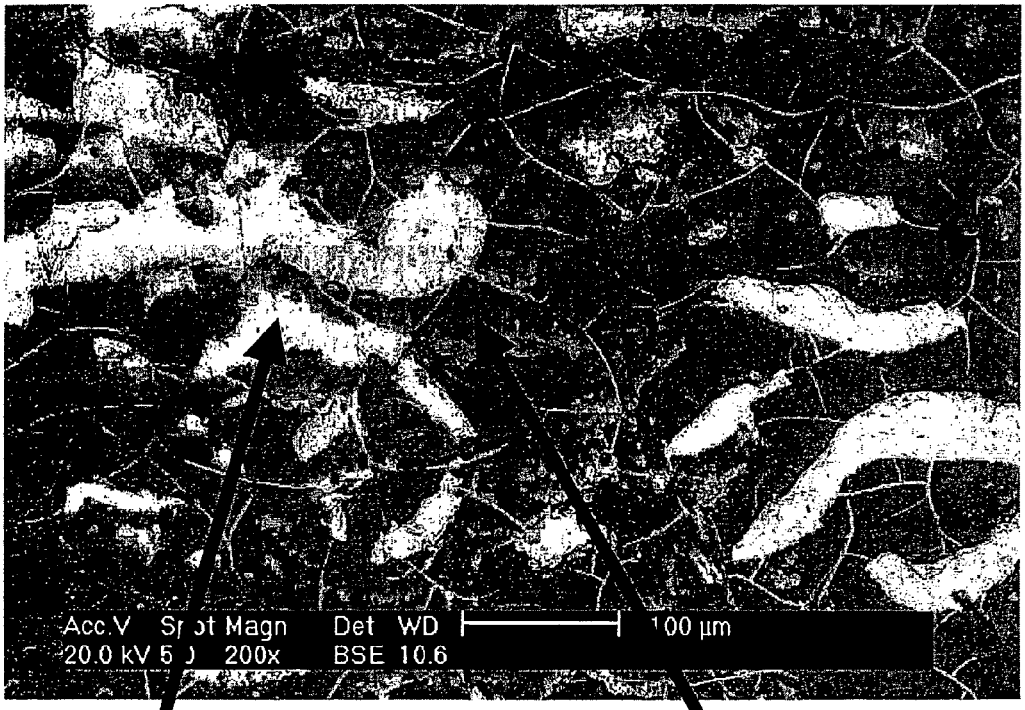

The product component coated in this manner has a surface, which, in addition to a high resistance to wear also possesses a very good sliding properties (FIG. 7).

EXAMPLE 8

A product component is coated according to the conditions of Example 1 with a conventional chromium layer.

Subsequently, a structured chromium layer is deposited on the chromium layer of Example 1 under the conditions of Example 2.

Figure 8:
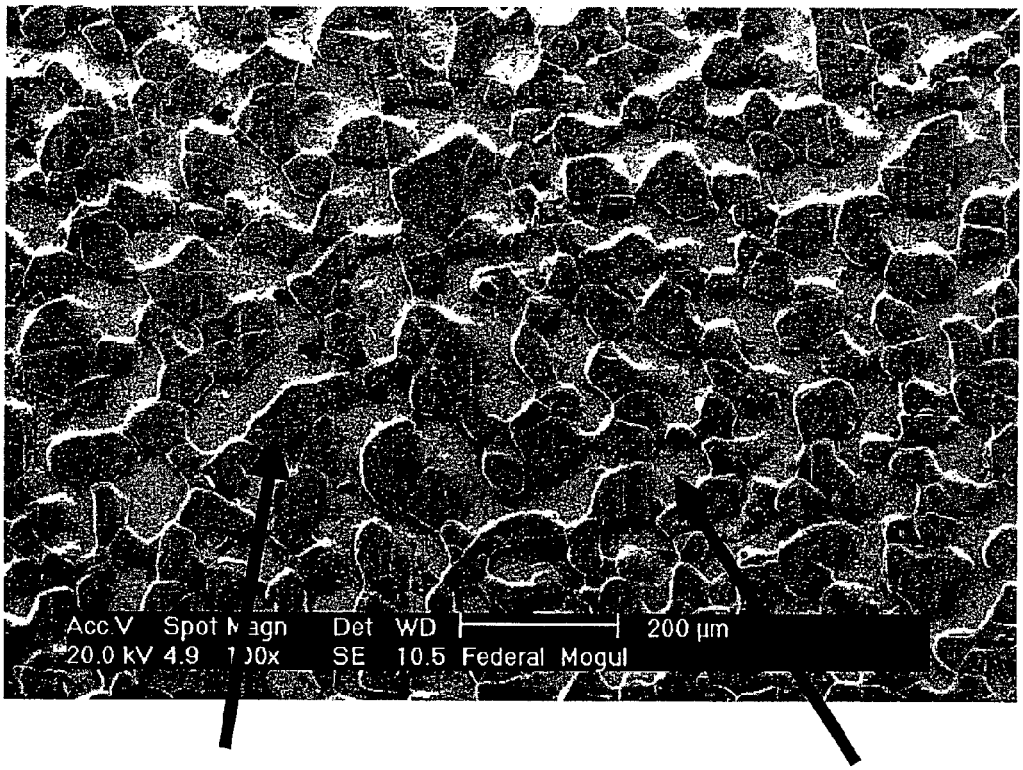

The structured chromium layer represents a lead-in layer for the conventional chromium layer and, depending on the tribological application, leads to an improvement of the laminar system (FIG. 8).

We claim:

1. An apparatus comprising:

a work-piece; and a structured hard chrome layer electrodeposited onto the work-piece, the structured hard chrome layer having a surface topography in a longitudinal direction and an axial direction, the structured hard chrome layer comprising at least one protruding structure that is irregularly-shaped in at least the longitudinal direction, and a plurality of recessed structures that are irregularly-shaped in at least the longitudinal direction, wherein the at least one irregularly-shaped protruding structure is chosen from one or more labyrinth structures, one or more column-shaped structures, and combinations thereof, and wherein the plurality of irregularly-shaped recessed structures are chosen from one or more cup shaped structures, one or more labyrinth structures, and combinations thereof;

wherein the plurality of irregularly-shaped recessed structures and the at least one irregularly-shaped protruding structure have no spherical laminar structure.

2. The apparatus of claim 1, further comprising a substance deposited on at least a portion of the structured hard chrome layer.

3. The apparatus of claim 2, wherein the substance deposited on at least a portion of the structured hard chrome layer is chosen from a plastic material, a dye, a metal material, a ceramic material, a solid lubricant, an electronic component, and a body-specific tissue.

4. The apparatus of claim 1, wherein the work-piece comprises a metal substance.

5. The apparatus of claim 1, wherein the work-piece comprises a non-metal substance.

6. The apparatus of claim 1, further comprising an outer layer deposited on the structured hard chrome layer, the outer layer chosen from a chromium layer, a black chromium layer, a copper layer, a nickel layer, and a tin layer.

7. The apparatus of claim 1, further comprising an inner layer deposited on the work-piece, the structured hard chromium layer electrodeposited onto the inner layer, the inner layer chosen from a chromium layer, a black chromium layer, a copper layer, a nickel layer, and a tin layer.

8. The apparatus of claim 1, wherein the work-piece is chosen from a piston ring, a cylinder, a piston, a bolt, a camshaft, a seal, a composite material, a valve, a bearing, a pressure cylinder, and an embossing roller.

* * * * *